US008757909B2

(12) United States Patent
Yasuzaki

(10) Patent No.: US 8,757,909 B2
(45) Date of Patent: Jun. 24, 2014

(54) IMAGE FORMING APPARATUS WITH CUTTING UNIT

(75) Inventor: Koji Yasuzaki, Tokorozawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 282 days.

(21) Appl. No.: 12/957,284

(22) Filed: Nov. 30, 2010

(65) Prior Publication Data

US 2011/0311293 A1 Dec. 22, 2011

(30) Foreign Application Priority Data

Jun. 18, 2010 (JP) ..... 2010-139965

(51) Int. Cl.
*B41J 11/42* (2006.01)
*B41J 11/66* (2006.01)

(52) U.S. Cl.
USPC ..... 400/583; 400/621; 347/19

(58) Field of Classification Search
CPC ..... B41J 3/60; B41J 2/13; B41J 2029/393; B41J 2029/3935; B41J 11/42; B41J 11/66; G03G 15/14; G03G 15/18
USPC ..... 347/19; 400/583, 621
See application file for complete search history.

(56) References Cited

U.S. PATENT DOCUMENTS

| | | | | |
|---|---|---|---|---|
| 4,857,715 | A * | 8/1989 | Koch et al. | 235/456 |
| 6,257,143 | B1 * | 7/2001 | Iwasaki et al. | 101/481 |
| 6,652,064 | B2 * | 11/2003 | Bruch et al. | 347/23 |
| 6,733,197 | B2 * | 5/2004 | Koike et al. | 400/621.1 |
| 6,832,825 | B1 * | 12/2004 | Nishikori et al. | 347/19 |
| 6,834,947 | B2 * | 12/2004 | Moriyama et al. | 347/96 |
| 7,108,434 | B2 * | 9/2006 | Silverbrook et al. | 400/76 |
| 7,681,978 | B2 * | 3/2010 | Hirato | 347/19 |
| 2002/0027575 | A1 | 3/2002 | Bruch | |
| 2002/0192003 | A1 | 12/2002 | Koike | |
| 2005/0052488 | A1 * | 3/2005 | Inoue | 347/19 |
| 2005/0158103 | A1 | 7/2005 | Silverbrook | |
| 2009/0297247 | A1 * | 12/2009 | Yaguchi | 400/621 |
| 2010/0166482 | A1 * | 7/2010 | Gocho | 400/621 |
| 2010/0238251 | A1 * | 9/2010 | Tsuzawa | 347/104 |
| 2011/0002010 | A1 * | 1/2011 | Mitsumatsu | 358/1.15 |
| 2011/0032577 | A1 * | 2/2011 | Gocho | 358/304 |
| 2011/0211899 | A1 * | 9/2011 | Teshigawara et al. | 400/621 |

FOREIGN PATENT DOCUMENTS

| | | | |
|---|---|---|---|
| JP | 11249346 | A * | 9/1999 |
| JP | 2003063115 | A * | 3/2003 |
| JP | 2008-126530 | A | 6/2008 |
| JP | 2008126530 | A * | 6/2008 |
| JP | 2009226758 | A * | 10/2009 |

* cited by examiner

*Primary Examiner* — Daniel J Colilla
*Assistant Examiner* — Quang X Nguyen
(74) *Attorney, Agent, or Firm* — Canon USA, Inc., IP Division

(57) ABSTRACT

A conveying unit conveys a continuous sheet, with a first end of the continuous sheet as the leading end. After an image forming unit forms page images on a first side of the continuous sheet, a cutting unit cuts off the continuous sheet. Then, for image formation on a second side opposite the first side, a duplex conveying unit conveys the continuous sheet to the conveying unit, with a second end of the continuous sheet as the leading end. The second end is opposite the first end and has been formed by cutting off the continuous sheet. In image formation only on the first side, the continuous sheet is cut off at a first position behind the last page image formed on the first side. In image formation on both the first and second sides, the continuous sheet is cut off at a second position behind the first position.

9 Claims, 11 Drawing Sheets

FIG. 11A

| ORDER OF PRINTING | FIRST SIDE | ORDER OF PRINTING | SECOND SIDE |
|---|---|---|---|
| ↓ | PRELIMINARY EJECTION | ↑ | MARGIN |
| | CUT MARK | | CUT MARK |
| | PAGE 1 | | PAGE 2 |
| | CUT MARK | | CUT MARK |
| | PAGE 3 | | PAGE 4 |
| | CUT MARK | | CUT MARK |
| | PAGE 5 | | PAGE 6 |
| | CUT MARK | | CUT MARK |
| | PRELIMINARY EJECTION | | PRELIMINARY EJECTION |
| | CUT MARK | | CUT MARK |
| | PAGE 7 | | PAGE 8 |
| | CUT MARK | | CUT MARK |
| | PAGE 9 | | PAGE 10 |
| | CUT MARK | | CUT MARK |
| | BLANK (AREA FOR PRELIMINARY EJECTION ON SECOND SIDE) | | PRELIMINARY EJECTION |
| | CUT MARK | | MARGIN |

FIG. 11B

| ORDER OF PRINTING | FIRST SIDE ONLY |
|---|---|
| ↓ | PRELIMINARY EJECTION |
| | CUT MARK |
| | PAGE 1 |
| | CUT MARK |
| | PAGE 2 |
| | CUT MARK |
| | PAGE 3 |
| | CUT MARK |
| | PRELIMINARY EJECTION |
| | CUT MARK |
| | PAGE 4 |
| | CUT MARK |
| | PAGE 5 |
| | CUT MARK |

IMAGE FORMING APPARATUS WITH CUTTING UNIT

BACKGROUND OF THE INVENTION

1. Field of the Invention

The present invention relates to image forming apparatuses capable of forming images on both sides of a roll sheet.

2. Description of the Related Art

Japanese Patent Laid-Open No. 2008-126530 discloses an image forming apparatus capable of aligning printing positions on front and back sides of a roll sheet with each other in duplex printing. After completion of printing on a front side of a sheet, this image forming apparatus captures an image of the leading end of the sheet to obtain position data of the sheet. From the position data obtained, the image forming apparatus determines a position for printing an image on the back side, and aligns printing positions on the front and back sides of the sheet with each other. Thus, the image forming apparatus can print images at correct positions on the sheet in duplex printing.

As described, Japanese Patent Laid-Open No. 2008-126530 discloses a technique which allows alignment of printing positions on front and back sides of a roll sheet in duplex printing. However, Japanese Patent Laid-Open No. 2008-126530 does not disclose a process of recording-head maintenance necessary for printing on the back side of a sheet. For example, no description is given of a process performed when preliminary ejection needs to be performed at the leading end of a continuous sheet before printing images on the back side, nor of a process performed when a management number needs to be printed.

SUMMARY OF THE INVENTION

The present invention is based on recognition of the problems described above. The present invention provides an image forming apparatus in which when image formation is to be performed on both first and second sides of a continuous sheet, image formation other than formation of page images can be performed before page images are formed on the second side.

An apparatus according to one aspect of the present invention includes a conveying unit configured to convey a continuous sheet, an image forming unit for forming a plurality of images on a first side and a second side of the continuous sheet conveyed by the conveying unit, a cutting unit configured to cut the continuous sheet, and a control unit for controlling the image forming unit to form a maintenance pattern or a plurality of images based on image information on the continuous sheet, wherein the control unit performs control such that the image forming unit forms a plurality of images based on image information on a first side, then the cutting unit cuts the continuous sheet at a position behind a last image on the first side, after cutting of the continuous sheet the image forming unit forms a maintenance pattern on a second side of the continuous sheet at a position which does not overlap with the last image based on image information on the first side, the maintenance pattern is nearer to a end formed by cutting after image formation of the first side than the last image based on image information on the first side.

The present invention makes it possible to provide an image forming apparatus in which when image formation is to be performed on both first and second sides of a continuous sheet, image formation other than formation of page images can be performed before page images are formed on the second side.

Further features of the present invention will become apparent from the following description of exemplary embodiments with reference to the attached drawings.

BRIEF DESCRIPTION OF THE DRAWINGS

FIG. 11A and FIG. 11B illustrate information registered in print management tables.

DESCRIPTION OF THE EMBODIMENTS

Exemplary embodiments of the present invention will now be described in detail with reference to the attached drawings. Note that relative arrangement of components and shapes of devices in the embodiments are described merely as examples, and are not intended to limit the scope of the invention to these examples.

In the present specification, the term "image forming apparatus" refers not only to apparatuses that are designed specifically for image forming purposes, but also to multifunction peripherals that combine image forming capability with other capabilities, and to manufacturing apparatuses that are capable of forming images and patterns on recording sheets.

Hereinafter, an embodiment of an inkjet printing apparatus serving as an image forming apparatus will be described. The printing apparatus to be described here is a high-speed line printer that uses rolls of continuous sheets, supports both simplex and duplex printing, and is suitable for large quantities of printing in printing laboratories etc. The present invention is applicable to printing apparatuses, such as printers, multifunction printers, copiers, and facsimiles. The present invention is applicable to a wide range of various other apparatuses, including industrial machines (e.g., for manufacture and inspection of various devices) that are used in factories, operate during the operating time specified by users, and take a long time to be initialized at the start-up.

Figure 1:
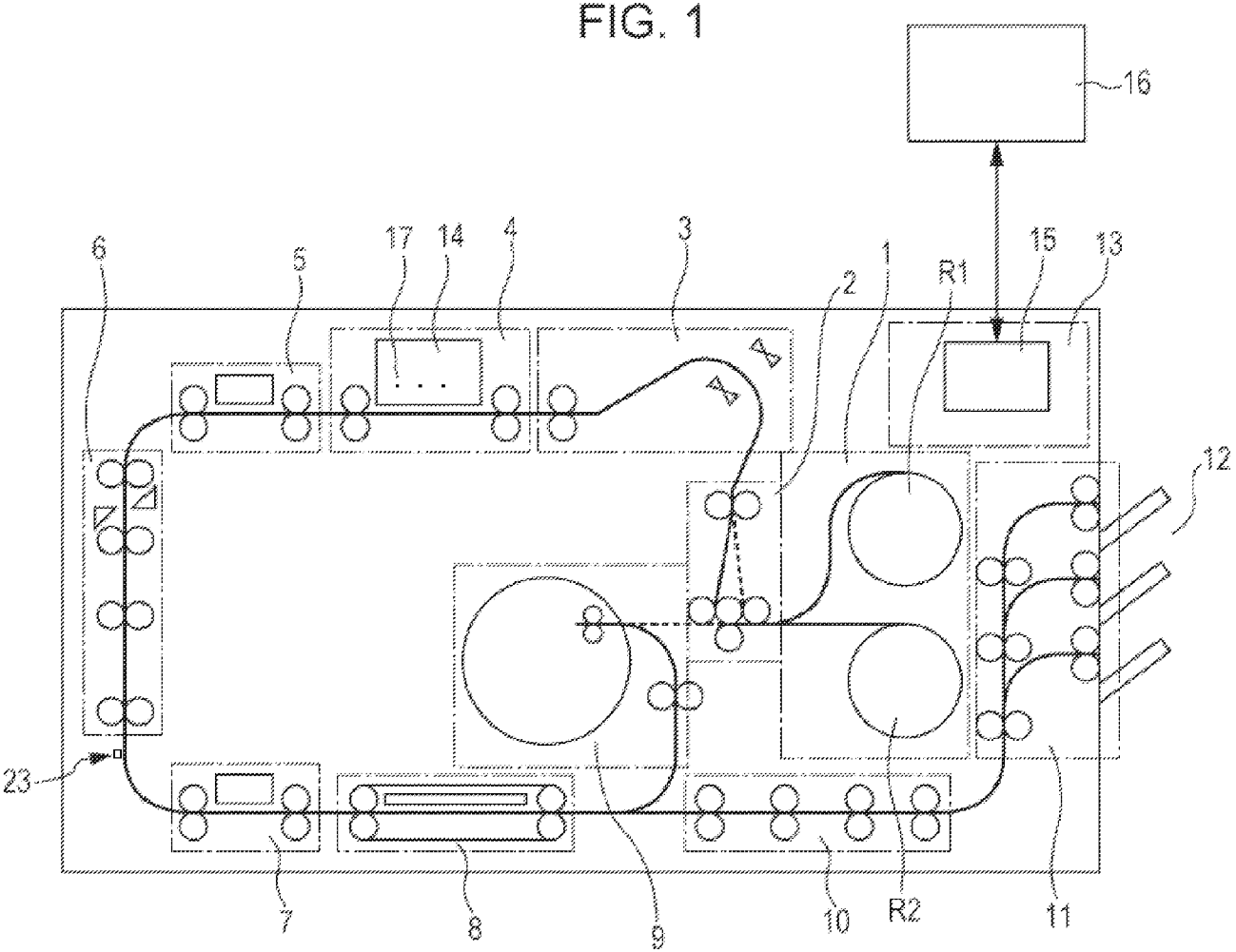
FIG. 1 is a schematic cross-sectional view illustrating an internal configuration of a printing apparatus.

FIG. 1 is a schematic cross-sectional view illustrating an internal configuration of a printing apparatus. The printing apparatus of the present embodiment is capable of duplex printing which allows printing of a roll sheet on both sides, that is, a first side and a second side opposite the first side. The printing apparatus primarily includes a sheet feeding unit 1, a decurling unit 2, a skew correcting unit 3, a printing unit 4, an inspecting unit 5, a cutter unit 6, an information recording unit 7, a drying unit 8, a reversing unit 9, a discharge conveying unit 10, a sorter unit 11, a discharging unit 12, and a control unit 13. A sheet is conveyed along a sheet conveying path (indicated by a thick line in FIG. 1) by a conveying mechanism including a roller pair and a belt, and is processed by each of the units described above.

The sheet feeding unit 1 is a unit that holds and feeds rolls of continuous sheets. The sheet feeding unit 1 can accommodate two rolls R1 and R2. The sheet feeding unit 1 draws and feeds a sheet from one of the rolls R1 and R2. The number of rolls that can be accommodated in the sheet feeding unit 1 is not limited to two, but may be one or more than two.

The decurling unit 2 is a unit that reduces the amount of curling (warping) of a sheet fed from the sheet feeding unit 1. The decurling unit 2 uses two pinch rollers for one driving roller to bend a sheet as it passes through so that it can be warped in the direction opposite that of curling. The decurling unit 2 thus applies a decurling force to the sheet to reduce the amount of curling.

The skew correcting unit 3 is a unit that corrects a skew of a sheet (i.e., an inclination of a sheet from its original direction of travel) that has passed through the decurling unit 2. A skew of a sheet is corrected by pressing a reference end of the sheet against a guiding member.

The printing unit 4 is a unit in which a print head array (image forming unit) 14 disposed above a conveyed sheet performs printing on the sheet to form images thereon. In other words, the printing unit 4 is a processing unit that performs predetermined processing on the sheet. In addition to the print head array 14, the printing unit 4 includes a plurality of conveying rollers (conveying unit) that convey the sheet. The print head array 14 includes a plurality of line-type print heads, each having an inkjet nozzle array that is formed across the maximum width of sheets to be used. In the print head array 14, a plurality of print heads are arranged in parallel in the conveying direction. In this embodiment, the print head array 14 has seven print heads corresponding to seven different colors, cyan (C), magenta (M), yellow (Y), light cyan (LC), light magenta (LM), gray (G), and black (K). Note that the number of colors and the number of print heads are not limited to seven. Examples of inkjet methods that can be used include a method using heating elements, a method using piezoelectric elements, a method using electrostatic elements, and a method using microelectromechanical systems (MEMS) elements. Inks of the respective colors are supplied through respective ink tubes to the print head array 14.

The inspecting unit 5 is a unit that uses a scanner to optically read test patterns or images printed on a sheet by the printing unit 4, checks the conditions of nozzles of the print heads, the state of sheet conveyance, and the positions of printed images, and determines whether the images have been printed correctly. The scanner includes a charge-coupled device (CCD) image sensor or a complementary metal oxide semiconductor (CMOS) image sensor.

The cutter unit (cutting unit) 6 is a unit that includes a mechanical cutter that cuts a printed sheet to a predetermined length. The cutter unit 6 also includes a plurality of conveying rollers for conveying the sheet to the next process.

The information recording unit 7 is a unit that records print information (unique information), such as a print serial number and a print date, in a non-print area of a cut sheet. Such print information is recorded, for example, by printing characters and codes using an inkjet method or a thermal transfer method. A sensor 23 that detects the leading end of a cut sheet is disposed upstream of the information recording unit 7 and downstream of the cutter unit 6. In other words, the sensor 23 is located between the cutter unit 6 and the recording position of the information recording unit 7. The timing of information recording of the information recording unit 7 is controlled on the basis of timing at which the sensor 23 detects the leading end of the cut sheet.

The drying unit 8 is a unit that heats a sheet printed by the printing unit 4 to quickly dry the ink applied to the sheet. The drying unit 8 internally applies hot air to the sheet as it passes through, at least from under the sheet, to dry the surface having the ink thereon. The drying method is not limited to that involves applying hot air to the sheet surface, but may be a method that involves irradiating the sheet surface with electromagnetic waves (e.g., ultraviolet light or infrared light).

The sheet conveying path extending from the sheet feeding unit 1 to the drying unit 8 is referred to as a first path. The first path is curved in U-shape between the printing unit 4 and the drying unit 8. The cutter unit 6 is located in the middle of the U-shape.

The reversing unit (duplex conveying unit) 9 is a unit that temporarily winds up a continuous sheet after completion of front-side printing in duplex mode, and reverses the continuous sheet. The reversing unit 9 is disposed along a path for feeding a sheet that has passed through the drying unit 8 to the printing unit 4. The path (loop path) that extends from the drying unit 8 through the decurling unit 2 to the printing unit 4 is referred to as a second path. The reversing unit 9 includes a winding rotary member (drum) that rotates to wind up a sheet. After front-side printing, a continuous sheet that has not been cut is temporarily wound up by the winding rotary member. Then, the winding rotary member rotates backward to feed the wound-up sheet to the decurling unit 2, from which the sheet is conveyed to the printing unit 4. Since the sheet has been reversed, the printing unit 4 can print on the back side of the sheet. The operation of duplex printing will be described more specifically later on.

The discharge conveying unit 10 is a unit that conveys a sheet that has been cut by the cutter unit 6 and dried by the drying unit 8 to the sorter unit 11. The discharge conveying unit 10 is disposed along a path (referred to as a third path) different from the second path along which the reversing unit 9 is disposed. To guide a sheet that has been conveyed along the first path to one of the second and third paths, a path switching mechanism having a movable flapper is provided at a point from which the second and third paths branch off.

The sorter unit 11 and the discharging unit 12 are disposed next to the sheet feeding unit 1 and at the downstream end of the third path. The sorter unit 11 is a unit that sorts printed sheets into groups, as necessary. The sorted sheets are discharged to the discharging unit 12 having a plurality of trays. The third path is thus laid out to allow printed sheets to pass below the sheet feeding unit 1 and to be discharged to the discharging unit 12, which is disposed opposite the printing unit 4 and the drying unit 8, with the sheet feeding unit 1 interposed therebetween.

The control unit 13 (control means) is a unit that controls each part of the entire printing apparatus. The control unit 13 includes a central processing unit (CPU), a storage device, various controllers, an external interface (I/F), and an operation unit 15 that allows the user to input and output data. The operation of the printing apparatus is controlled in accordance with commands from the controllers or a host device 16, such as a host computer. The host device 16 is connected to the controllers through the external I/F.

Figure 2:
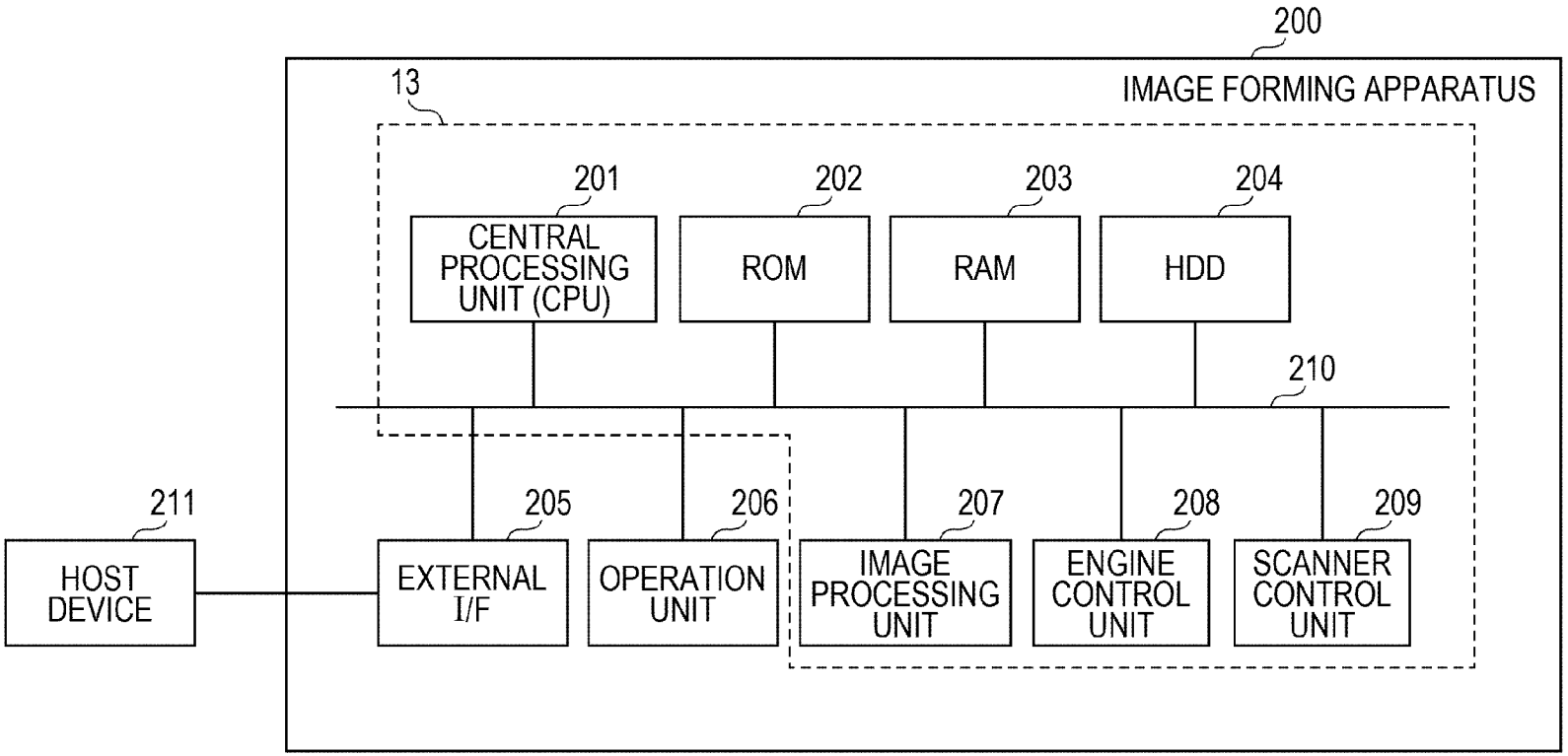
FIG. 2 is a block diagram for explaining a control configuration of an image forming apparatus according to an embodiment of the present invention.

FIG. 2 is a block diagram for explaining a configuration of a control unit 13 in an image forming apparatus 200 applied in the present embodiment. The control unit 13 includes, for example, a CPU 201 in the form of a microcomputer, a read-only memory (ROM) 202 that stores fixed data including programs and necessary tables, and a random-access memory (RAM) 203 that provides a working area and an area for storing control commands received from a host device 211. The control unit 13 also includes a hard disk drive (HDD) 204 that temporarily stores necessary tables and image data supplied from the host device 211. A display operation unit 206 includes a display that displays an apparatus status. The display operation unit 206 is used to check an operation instruction input by the operator, various kinds of registered data, and the apparatus status. The control unit includes an image processing unit 207 which performs image processing for the image forming apparatus 200. The image processing unit 207 converts a color space of image data (e.g., YCbCr) into a standard RGB color space (e.g., sRGB). Also, the image processing unit 207 performs various types of image processing, such as conversion of resolution to the number of effective pixels, image analysis, and image correction as necessary. Print data obtained by such image processing is stored in the RAM 203 or the HDD 204. The control unit 13 includes an engine control unit 208 which performs control for printing print data on a recording medium in accordance with a received control command. The engine control unit 208 issues an ink ejection instruction to print heads for respective colors, sets the ejection timing for adjusting dot positions on the recording medium, and obtains a head driving state. In accordance with print data, the engine control unit 208 controls driving of the print heads, and causes the print heads to eject inks to form an image on the recording medium. Additionally, the engine control unit 208 issues an instruction to drive paper-feed rollers, issues an instruction to drive conveying rollers, and obtains a rotating state of the conveying rollers. The engine control unit 208 thus controls the conveying rollers to convey the recording medium at an appropriate speed and to stop conveying the recording medium. The control unit 13 includes the scanner control unit 209 which controls an image sensor, such as a CCD sensor or a contact image sensor (CIS), in accordance with a received control command, reads an image on a recording medium, and obtains analog luminance data of red (R), green (G), and blue (B) colors. The scanner control unit 209 issues an instruction to drive the image sensor, obtains a state of the image sensor, analyzes the luminance data obtained from the image sensor, and detects non-ejection and a cutting position for cutting the recording medium. The host device 211 is an external device that is connected to the image forming apparatus 200 and serves as a supply source that supplies images to the image forming apparatus 200. The host device 211 may be, for example, a computer that generates and processes data of images to be printed, or a reader for image reading. Image data and commands supplied from the host device 211 and status signals can be transmitted to and received from the image forming apparatus 200 through an external I/F 205. The foregoing constituent units of the image forming apparatus 200 are connected to one another via a system bus 210. Note that the control configuration is not limited to that described in the present embodiment. Control may be performed on the basis of a configuration in which the processing units and control units described above are divided into a plurality of groups, each having a CPU.

Basic operations in printing will now be described. Printing in simplex and duplex modes, which allow different operations, will be described here.

Figure 3:
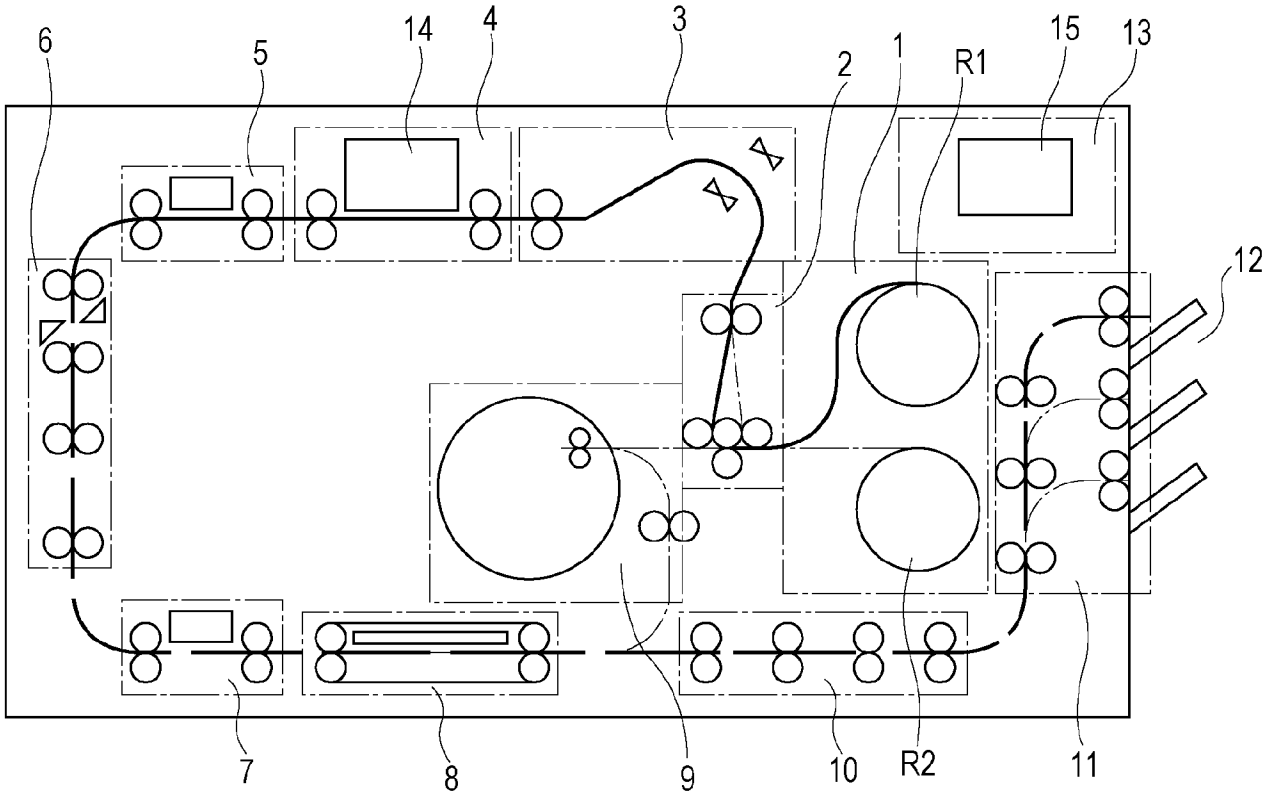
FIG. 3 is a diagram for explaining an operation in simplex mode.

FIG. 3 is a diagram for explaining an operation in simplex mode. Note that a conveying path along which a sheet fed from the sheet feeding unit 1 is printed and discharged to the discharging unit 12 is indicated by a thick line. A long continuous sheet fed from the sheet feeding unit 1 and processed by the decurling unit 2 and the skew correcting unit 3 is conveyed to the printing unit 4, where a front side (first side) of the continuous sheet is printed. A plurality of images, each having a predetermined unit length in the conveying direction (unit images), are sequentially printed on the sheet. The printed sheet passes through the inspecting unit 5 and is cut by the cutter unit 6 into cut sheets, each having a unit image thereon. As necessary, the information recording unit 7 records print information on the back side of each of the cut sheets. The cut sheets are conveyed one by one to the drying unit 8 and dried. After passing through the discharge conveying unit 10, the cut sheets are sequentially discharged through the sorter unit 11 to the discharging unit 12 and stacked. On the other hand, the continuous sheet which has been left around the printing unit 4 after being cut and separated from the last unit image is conveyed back to the sheet feeding unit 1 and wound up onto the roll R1 or R2. Thus, in simplex printing, a sheet is processed as it passes along the first path and the third path, not along the second path.

Figure 4:
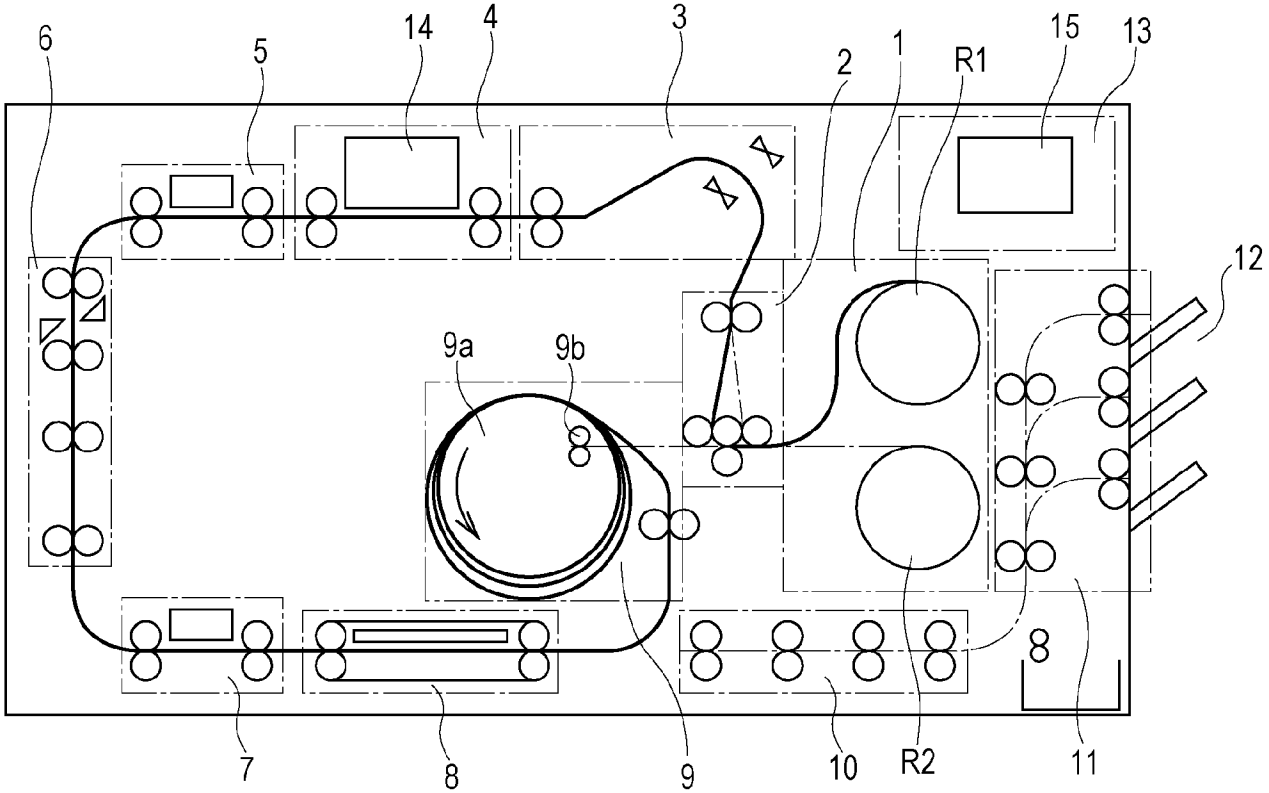
FIG. 4 is a diagram for explaining an operation in duplex mode.

FIG. 4 is a diagram for explaining an operation in duplex mode. In duplex printing, a back-side (second-side) printing sequence is executed after execution of a front-side (first-side) printing sequence. In the front-side printing sequence, an operation in each of the units, from the sheet feeding unit 1 to the inspecting unit 5, is the same as that in simplex printing. Then, without being cut by the cutter unit 6, a continuous sheet is conveyed to the drying unit 8, where ink on the front side of the continuous sheet is dried. The continuous sheet is then guided not to the discharge conveying unit 10 (third path) but to the reversing unit 9 (second path). In the second path, the continuous sheet is gripped at the leading end (first end) thereof by a roller pair 9*b* of a winding rotary member 9*a* in the reversing unit 9, and wound onto the rotating winding rotary member 9*a* in the forward direction (counterclockwise in the drawing). After completion of intended front-side printing in the printing unit 4, the continuous sheet is cut by the cutter unit 6 at a position behind the printed area. This cutting position becomes the trailing end (second end) of the printed continuous sheet. The printed continuous sheet, which is located downstream of the cutting position in the conveying direction, is conveyed through the drying unit 8 and completely wound up by the reversing unit 9 until the trailing end (cutting position) of the sheet is reached. At the same printing apparatus, the remaining continuous sheet located upstream of the cutting position in the conveying direction (i.e., the continuous sheet remaining around the printing unit 4) is conveyed back to the sheet feeding unit 1 and wound up onto the roll R1 or R2 such that the leading end (cut portion) of the sheet is not left in the decurling unit 2. This wind-up operation can prevent collision with the sheet to be fed again in the back-side printing sequence.

Figure 5:
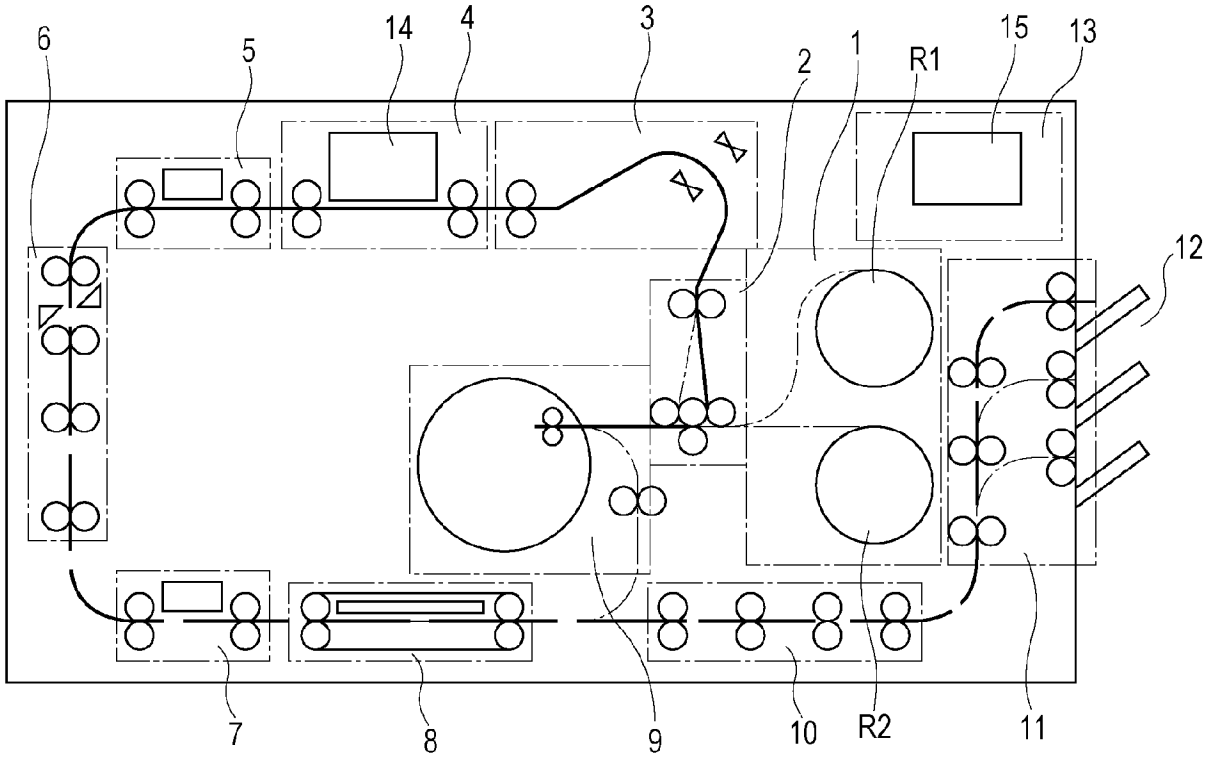
FIG. 5 is a diagram for explaining an operation of printing on a second side in duplex mode.

After the front-side printing sequence described above, the sequence is switched to the back-side printing sequence. The winding rotary member in the reversing unit 9 rotates in the direction opposite that in the winding operation (clockwise in the drawing). As illustrated in FIG. 5, the wound-up sheet in the reversing unit 9 is fed out to the decurling unit 2 along a path indicated by a thick line, with the second end of the sheet as the leading end. Note that the trailing end (second end) of the sheet in the winding operation becomes the leading end of the sheet when the sheet is fed out. The decurling unit 2 corrects curling caused by the wind-up operation in the winding rotary member. The decurling unit 2 is disposed between the sheet feeding unit 1 and the printing unit 4 in the first path, and is disposed between the reversing unit 9 and the printing unit 4 in the second path. That is, the decurling unit 2 is a common unit that serves as a decurling function in both paths. The sheet reversed by the reversing unit 9 passes through the skew correcting unit 3 and is fed to the printing unit 4, where the back side of the sheet is printed. The printed sheet passes through the inspecting unit 5 and is cut by the cutter unit 6 into cut sheets, each having a predetermined unit length. Since the cut sheets are printed on both sides, nothing is recorded by the information recording unit 7. The cut sheets are conveyed one by one to the drying unit 8, pass through the discharge conveying unit 10, and are sequentially discharged through the sorter unit 11 to the discharging unit 12 and stacked. Thus, in duplex printing, a sheet is processed as it passes along the first path, the second path, the first path, and the third path in this order.

Figure 6:
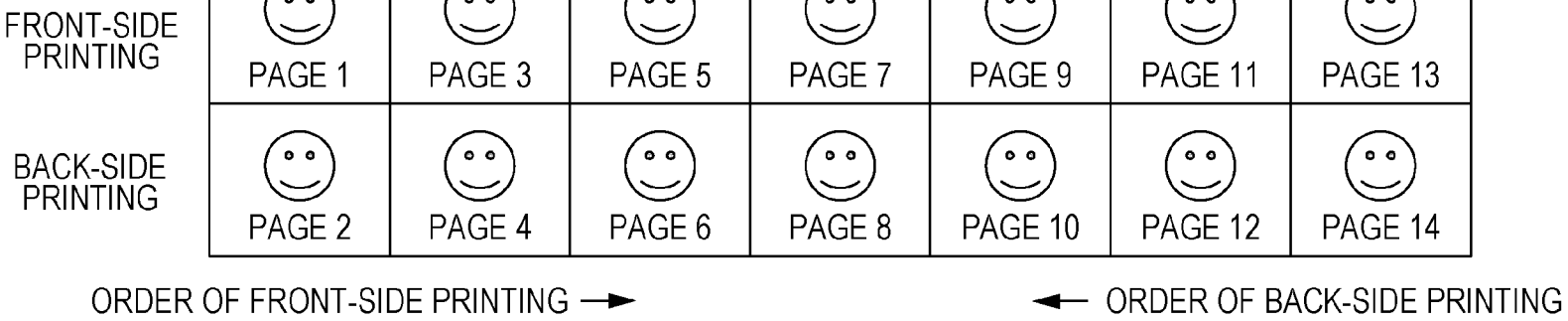
FIG. 6 illustrates the order of pages printed on a roll sheet in duplex mode in accordance with an embodiment of the present invention.

FIG. 6 illustrates the order of pages printed on a roll sheet in duplex mode. In duplex printing, the first side (front side) of a sheet is printed first. The image processing unit 207 generates images to be printed on both sides. After generating images to be printed on the front side, the image processing unit 207 transmits the image data to the engine control unit 208 as an instruction to start front-side printing. Upon receipt of the instruction, the engine control unit 208 causes the sheet feeding unit 1 to feed a sheet. After passing through the decurling unit 2 and the skew correcting unit 3, the sheet is conveyed to the printing unit 4, where the images to be printed are printed on the front side of the sheet. The sheet is further conveyed to the inspecting unit 5, where the printed images are read by the scanner of the inspecting unit 5 and checked by the scanner control unit 209. The sheet is further conveyed to the cutter unit 6. In the front-side printing, the cutter unit 6 does not cut the sheet into cut sheets of print unit length. The sheet is passed through the drying unit 8 and dried. The sheet is then wound onto the winding drum of the reversing unit 9.

The operation described above continues until all images to be printed on the front side are printed. Upon completion of the front-side printing, the image processing unit 207 transmits image data for the second side (back side) to the engine control unit 208 as an instruction to start back-side printing. For back-side printing, the sheet printed on the front side and wound on the winding drum is conveyed to the decurling unit 2, and further conveyed through the skew correcting unit 3 to the printing unit 4. Then, at positions corresponding to the respective images on the front side, images to be printed are printed on the back side of the sheet. The sheet is then conveyed to the inspecting unit 5, where the printed images are checked. The sheet is further conveyed to the cutter unit 6. After the back-side printing, the cutter unit 6 cuts the sheet into cut sheets, each having a length of a unit image. The cut sheets are passed through the drying unit 8 and dried. The cut sheets are then conveyed one by one (image by image) to one or more specified trays of the discharging unit 12. In duplex printing, images are arranged in order of command transmission. Specifically, odd-numbered pages are arranged and printed on the front side, while even-numbered pages are arranged and printed on the back side. The pages are printed in ascending order on the front side, and in descending order on the back side.

Figure 7A:
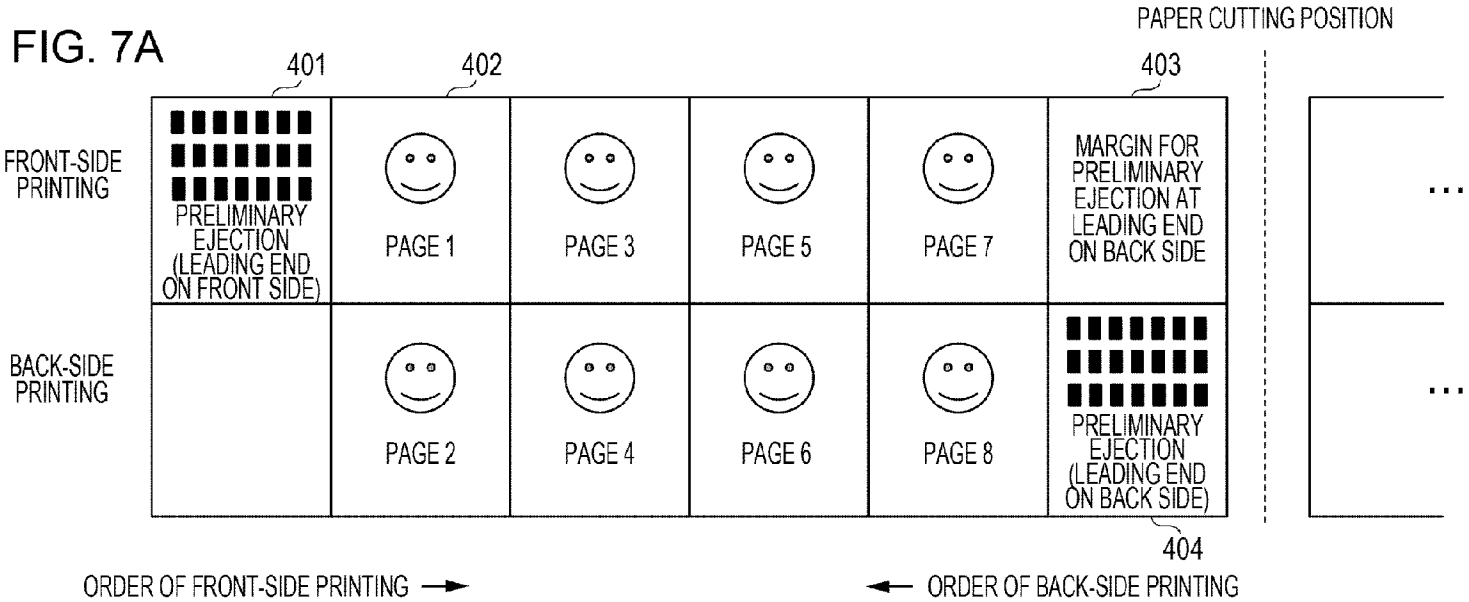
FIG. 7A illustrates a roll sheet printed in duplex mode where front-side printing is performed with consideration to processing necessary for back-side printing, in accordance with an embodiment of the present invention.

FIG. 7A illustrates a result of duplex printing on a continuous sheet. In this duplex printing, front-side printing is performed with consideration to back-side printing in which a pattern necessary for maintenance of print heads is to be printed, as well as images based on image information. When images for the front side are generated by the image processing unit 207 and the corresponding image data is transmitted from the image processing unit 207, the engine control unit 208 inserts a necessary preliminary ejection area at the start of front-side printing, at a position indicated by "401". Then, a preliminary ejection pattern is printed near the first end, which serves as the leading end of the sheet in the front-side printing. Printing of page images on the front side starts at a position indicated by "402". Odd-numbered pages are printed first. When the end of printing is reached during printing of page 7 illustrated in FIG. 7A, the engine control unit 208 calculates the length of a preliminary ejection area necessary for back-side printing. At a position indicated by "403", the engine control unit 208 leaves a margin corresponding to the calculated length, behind the trailing end of page 7. Then, the sheet is cut at a position behind the left margin. This margin corresponds to a management recording portion where a management image, such as a preliminary ejection pattern, is recorded during image formation on the second side.

After the front-side printing, when image data for the back side is transmitted from the image processing unit 207, the engine control unit 208 starts printing on the back side. At the start of back-side printing, the engine control unit 208 prints a preliminary ejection pattern in the management recording portion at a position indicated by "404". In back-side printing, the second end opposite the first end becomes the leading end of the sheet. As illustrated, the preliminary ejection pattern is printed between the second end and the first page on the second side of the sheet. The preliminary ejection pattern on the second side does not overlap (partially or fully) with the last page on the first side. The preliminary ejection pattern on the second side is nearer to the second end than the last page on the first side so in other words there is less distance between the preliminary ejection pattern on the second side and the second end than between the last page on the first side and the second end. Then, even-numbered pages are printed in descending order. The first page on the back side is printed at a position aligned with the last printed page on the front side. Each page on the back side is positioned consistently (preferably fully overlapping) with correspondent page on the front side.

Figure 7B:
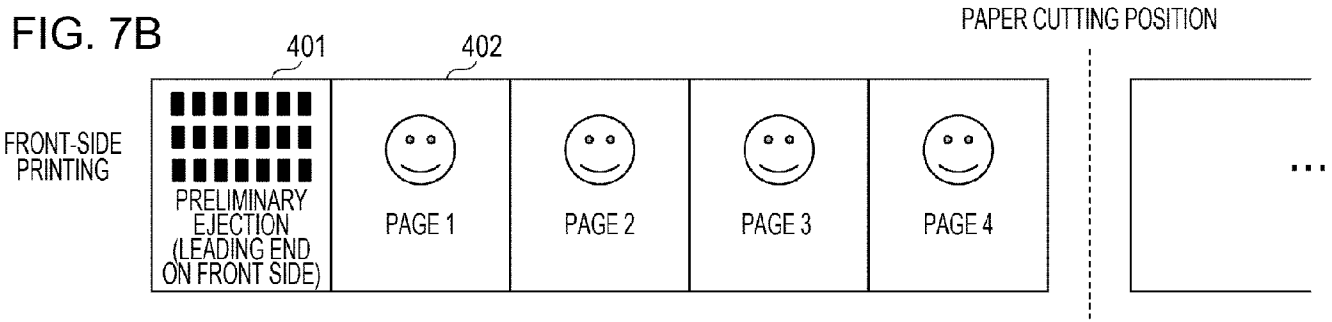
FIG. 7B illustrates a roll sheet printed in simplex mode.

FIG. 7B illustrates a result of simplex printing in which only the front side of a continuous sheet is printed. The continuous sheet is cut behind the trailing end of page 4. As illustrated, no preliminary ejection area for the back side is left.

Figure 8:
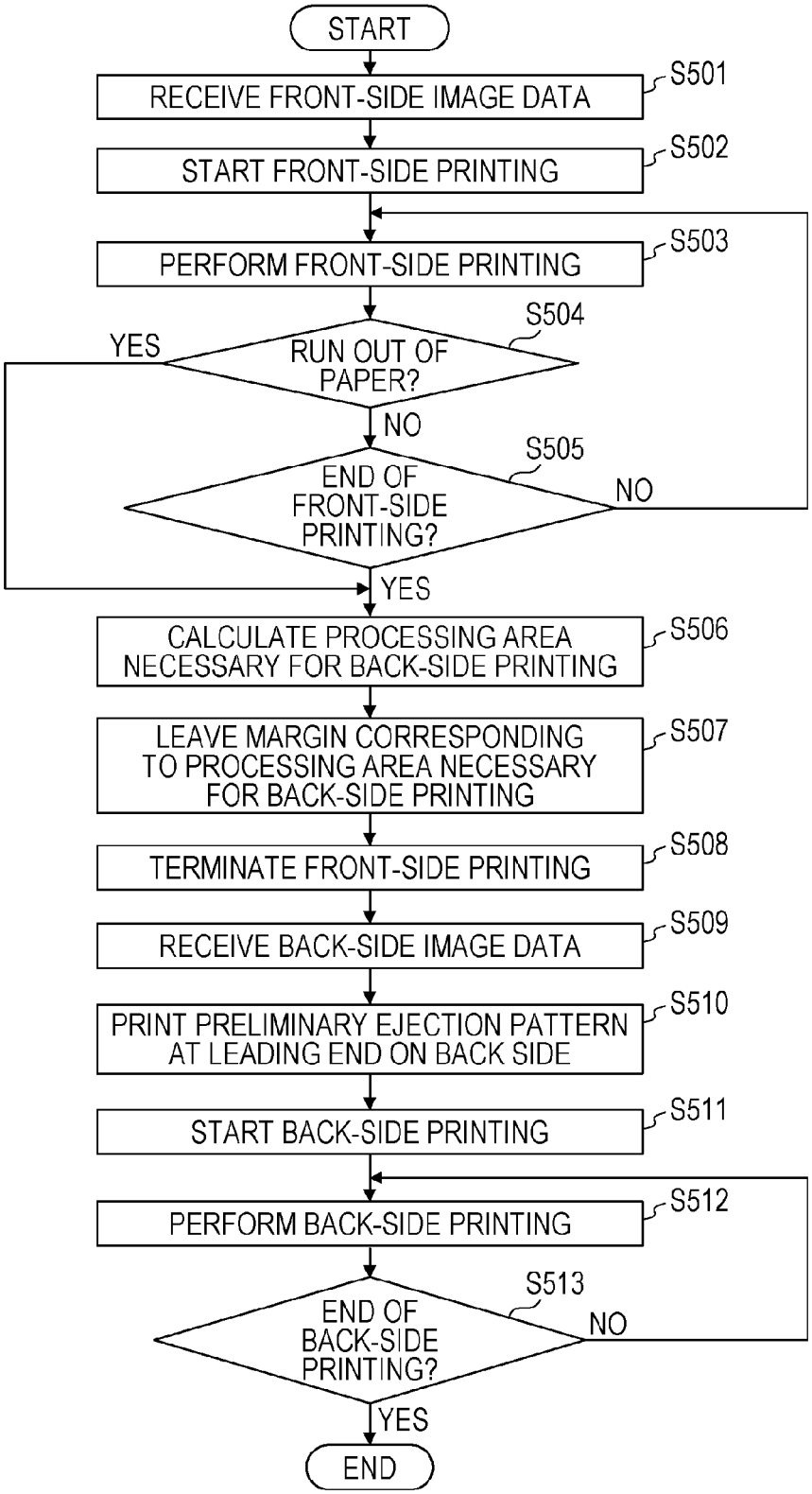
FIG. 8 is a flowchart illustrating a process of printing on a roll sheet in duplex mode where front-side printing is performed with consideration to processing necessary for back-side printing, in accordance with an embodiment of the present invention.

FIG. 8 is a flowchart illustrating a process of duplex printing on a roll sheet. In this process, front-side printing is performed with consideration to processing necessary for back-side printing. In step S501, image data for the front side is transmitted from the image processing unit 207 to the engine control unit 208. Upon receipt of the image data, the engine control unit 208 starts the front-side printing in step S502. In step S503, the engine control unit 208 performs the front-side printing. If the image forming apparatus 200 has run out of paper in step S504 (YES in step S504), the process proceeds to step S506, where the engine control unit 208 calculates the size of a processing area necessary for back-side printing. In the present embodiment where a preliminary ejection pattern needs to be printed at the start of back-side printing, the engine control unit 208 calculates the size of an area necessary for printing the preliminary ejection pattern. If the image forming apparatus 200 has not run out of paper in step S504 (NO in step S504), the process proceeds to step S505, where the engine control unit 208 checks whether the front-side printing has been completed. If the front-side printing has not been completed (NO in step S505), the process returns to step S503 and the engine control unit 208 continues to print on the front side. If the front-side printing has been completed (YES in step S505), the process proceeds to step S506, where the engine control unit 208 determines a cutting position at the trailing end of the last image on the front side, and prints a cut mark at the cutting position. Additionally, the engine control unit 208 calculates a processing area, which is the sum of the area for preliminary ejection necessary at the leading end of the continuous sheet at the start of back-side printing, an area for printing a cut mark for cutting off the preliminary ejection area, an area for adjusting print positions on the front and back sides, etc. In step S507, the engine control unit 208 determines a cutting position for leaving a margin behind the last image on the front side, the margin corresponding to the processing area calculated in step S506, when the continuous sheet printed on the front side is separated from the roll sheet. That is, in step S507, a position located downstream of the trailing end of the last image on the front side by the length of the processing area calculated in step S506 is determined as a cutting position at which the continuous sheet is separated from the roll sheet. Then, the engine control unit 208 registers information about this cutting position in a print management table and prints the cut mark. In step S508, the engine control unit 208 terminates the process of front-side printing and cuts off the continuous sheet. The continuous sheet printed on the front side is wound by the reversing unit 9, while the non-printed sheet is wound up onto the roll R1 in the sheet feeding unit 1. After the wind-up operation, the engine control unit 208 waits for transmission of image data for the back side from the image processing unit 207. Upon receipt of the image data in step S509, the engine control unit 208 prints, in step S510, a preliminary ejection pattern on the back side of the margin left in step S507. In step S511, the engine control unit 208 starts the back-side printing. In step S512, the engine control unit 208 performs the back-side printing. In step S513, the engine control unit 208 checks whether the back-side printing has been completed. If the back-side printing has been completed (YES in step S513), the back-side printing ends here. If the back-side printing has not been completed (NO in step S513), the process returns to step S512 and the engine control unit 208 continues to print on the back side.

In front-side printing, the continuous sheet is not cut at the trailing end of each image. This means that the back-side printing is performed on the continuous sheet on which a plurality of images have been printed on the front side. In back-side printing, the continuous sheet is cut at the trailing end of each image. In this operation, a cut mark printed at the trailing end of each image on the back side is used as a trigger. Printed matter printed on both front and back sides is thus obtained.

Next, a description will be given of another embodiment in which two different types of print jobs, simplex and duplex print jobs, are randomly transmitted.

Figure 9:
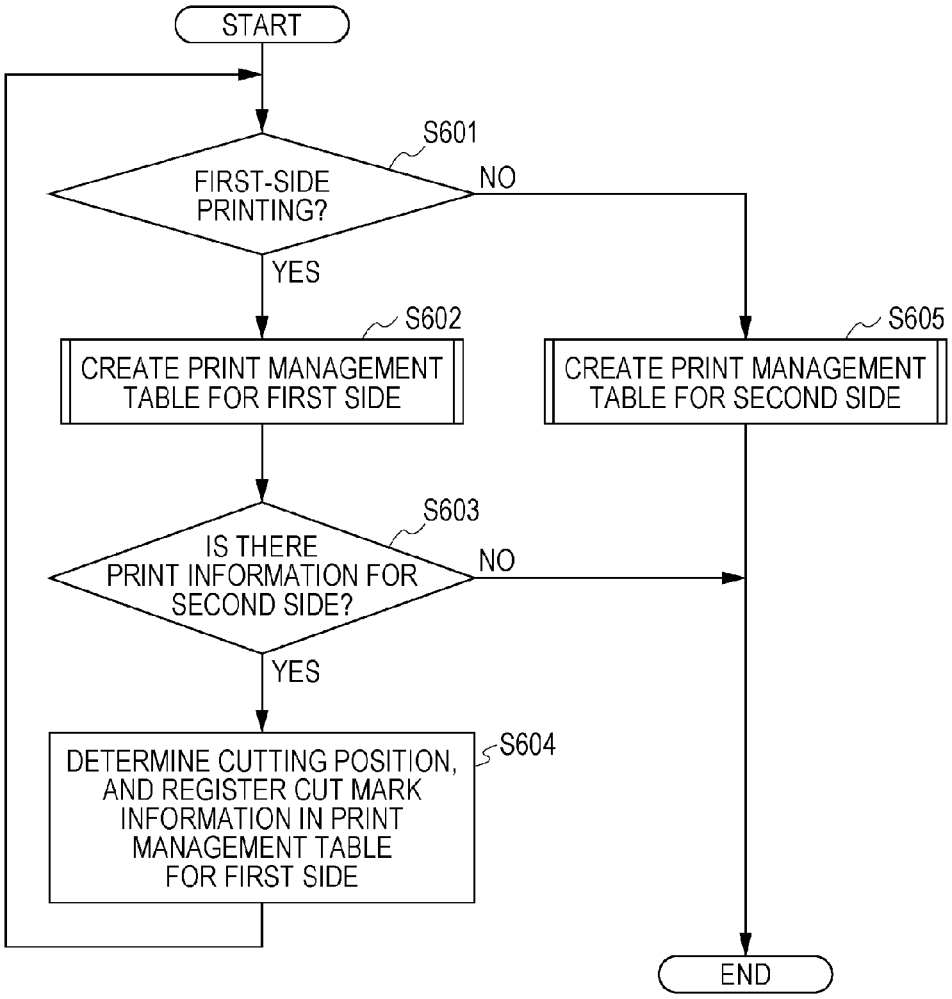
FIG. 9 is a flowchart illustrating a process of creating a print management table.

FIG. 9 is a flowchart illustrating a process of creating a print management table. In step S601, a determination is made as to whether printing in progress is printing on the first side. If it is printing on the first side (YES in step S601), the process proceeds to step S602, where a print management table for the first side is created. Information stored in the print management table in step S602 includes image information for each page, and pattern information and position information about cut marks, each serving as a trigger for cutting a continuous sheet at the trailing end of each page. In step S603, a determination is made as to whether there is print information for the second side. If print information for the second side is not present (NO in step S603), the print job in progress is a simplex print job. Therefore, the process of creating a print management table ends here. If there is print information for the second side (YES in step S603), the print job in progress is a duplex print job. In this case, if the continuous sheet is cut at the trailing end of the last page on the first side, there is no area for preliminary ejection at the leading end of the continuous sheet in printing on the second side. In step S604, to create an area for preliminary ejection at the leading end of the continuous sheet in printing on the second side, a cutting position is set at a position that is behind the trailing end of the last page on the first side by the length of the area necessary for preliminary ejection etc. This area includes the area for preliminary ejection and an area for printing a cut mark for cutting off a portion where a preliminary ejection pattern is printed. Then, also in step S604, cut-mark pattern information and cutting position information are registered in the print management table for the first side.

The process then returns to step S601 and proceeds to step S605, where a print management table for the second side is created. The process thus ends.

Figure 10:
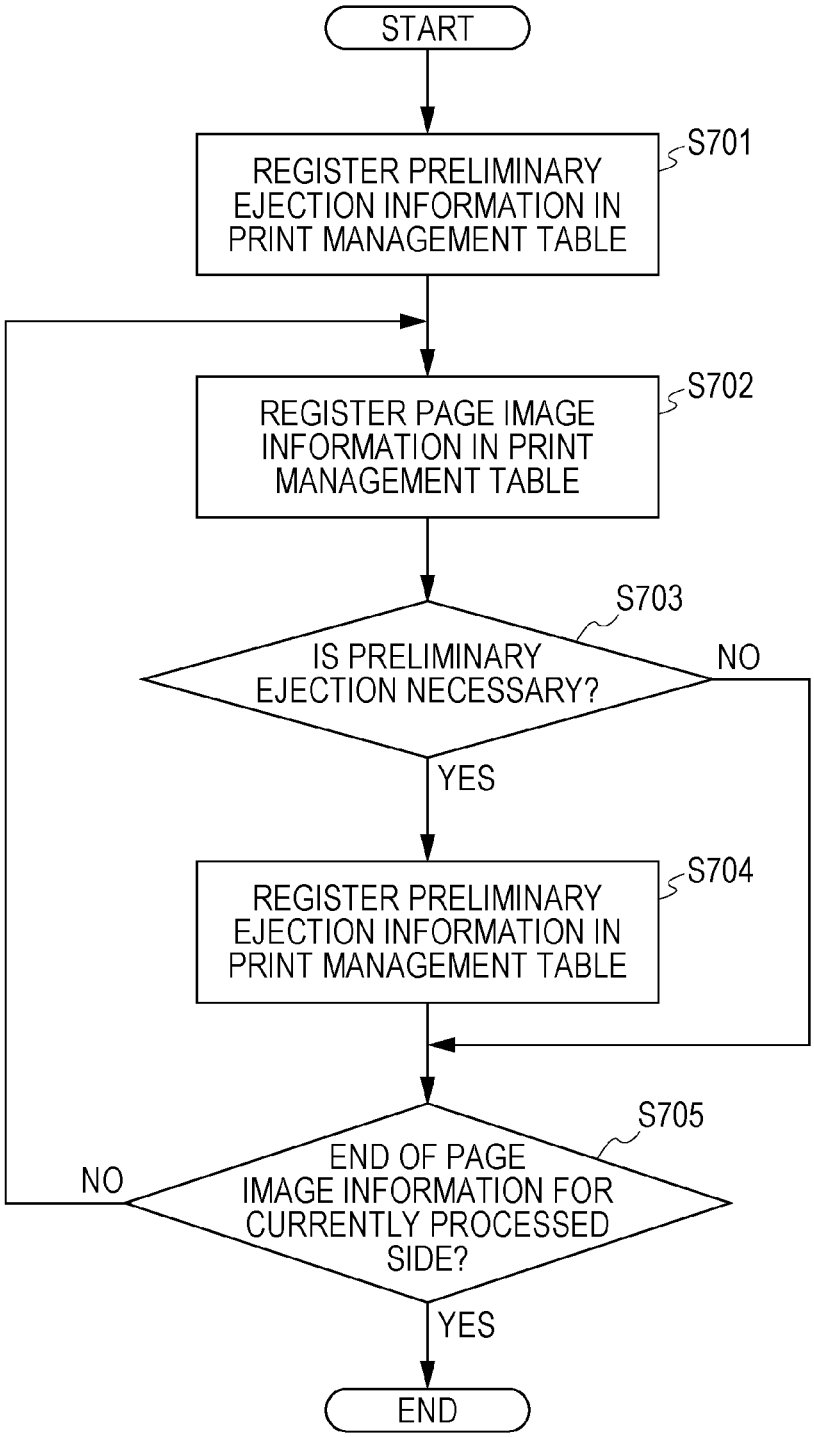
FIG. 10 is a flowchart illustrating a common process of creating a print management table for both first and second sides.

FIG. 10 is a flowchart illustrating a common process of creating a print management table for both first and second sides of a continuous sheet. That is, step S602 or step S605 of FIG. 9 is illustrated in detail in FIG. 10. In step S701, pattern information and position information about preliminary ejection performed before printing of the first page are registered in a print management table. In printing on the first side, a preliminary ejection pattern is printed near the first end, which is the leading end of a continuous sheet that has not yet been separated from a roll sheet. In printing on the second side, a preliminary ejection pattern is printed near the second end, which is opposite the first end of the continuous sheet separated from the roll sheet.

In step S702, image information and position information for a page, and information about a cut mark at the trailing end of the page are registered in the print management table. In step S702, a determination is made as to whether preliminary ejection is to be performed after the cut mark for the page. Preliminary ejection is performed to prevent degradation of ejection performance. For example, ejection performance may be degraded when less frequently used ejection ports 17 of a print head array 14 are clogged with ink which has become viscous due to evaporation. To ensure ink ejection performance, preliminary ejection is generally performed such that an interval between the previous preliminary ejection and the next one is within a predetermined period of time. If it is determined that preliminary ejection is necessary (YES in step S703), the process proceeds to step S704, where data of a preliminary ejection pattern, position information for the preliminary ejection pattern, and information about a cut mark for cutting off the preliminary ejection pattern are registered. If preliminary ejection is not necessary (NO in step S703), or after registration of preliminary ejection information in step S704, the process proceeds to step S705, where a determination is made as to whether the end of page image information for the currently processed side of the continuous sheet has been reached. If there is image data for the next page (NO in step S705), the process returns to step S702. If the end of page image data has been reached (YES in step S705), the process of creating a print management table ends.

FIG. 11A illustrates information registered in print management tables for duplex printing. In a print management table for the first side, data of a preliminary ejection pattern to be printed before printing of page images is stored, first. Then, image data of odd-numbered pages is stored in ascending order. Data of another preliminary ejection pattern is stored in the middle of the page image data so that preliminary ejection is performed at a predetermined time during printing. The data of each page image and each preliminary ejection pattern includes position information indicating a printing position.

As illustrated, there is a blank following a cut mark after page 9, which is the last page in the print management table for the first side. This blank is provided so that an area for printing a preliminary ejection pattern can be created at the beginning of the second side. After the blank, information about a cut mark for cutting off the continuous sheet from the roll sheet is stored. A blank field is illustrated for ease of understanding, but this does not necessarily mean that there is blank data in this field. The blank is formed on the continuous sheet by determining information about the positions of the cut mark at end of the first side and the cut mark immediately before the blank. This blank corresponds to a management recording portion where a management image is formed during image formation on the second side.

A print management table for the second side is illustrated upside down, relative to that for the first side, so that it is easier to understand a correspondence between the front side and the back side. In the print management table for the second side, data of a preliminary ejection pattern to be printed at the beginning is stored, first. Then, image data of even-numbered pages arranged in descending order and cut mark information are stored. Data of another preliminary ejection pattern is stored in the middle of the page image data.

For comparison, a print management table for simplex printing where only the first side is printed is illustrated in FIG. 11B. As illustrated, cut mark information is stored after page 5, which is the last page, and there is no data after this cut mark information. When only the first side is to be printed, the continuous sheet is cut at a position behind the last page printed on the first side. When the second side is to be printed after printing on the first side, the continuous sheet is cut at a position that is behind the last page printed on the first side and is further behind the position in the case where only the first side is to be printed.

Note that a printing operation may be performed after completion of creating a print management table, or in parallel with creation of a print management table.

In simplex printing (i.e., printing on the first side only), a continuous sheet is printed by the printing unit 4 and cut into pages by the cutter unit 6 downstream of the printing unit 4 in accordance with cut marks.

In duplex printing (i.e., printing on both the first and second sides), a continuous sheet is not cut into pages during printing on the first side, but is cut off at a cut mark that is behind a cut mark immediately behind the last page. After being cut off, the continuous sheet is temporarily wound up onto the winding drum in the reversing unit 9, and is fed again to the printing unit 4 for printing on the second side. In printing on the second side, the continuous sheet is printed by the printing unit 4 and cut into pages by the cutter unit 6 downstream of the printing unit 4 in accordance with cut marks. Printed matter printed on both sides can thus be obtained.

In the embodiments described above, a preliminary ejection pattern is printed as a maintenance pattern (management image) at the leading end of each of the first and second sides of a continuous sheet. Examples of the maintenance image in the form of a maintenance pattern include not only the preliminary ejection pattern, but also a pattern for detecting an ejection failure in ejection ports of a print head, a pattern for detecting accuracy of conveyance, and a pattern for determining a correction value for correcting the amount of drive of conveying rollers. Instead of a maintenance pattern, management information for printed matter may be recorded as a management image. When a management recording portion for recording management information, such as a management number, is to be reserved at the leading end of the continuous sheet on the second side, a margin corresponding to the management recording portion is left at the trailing end of the continuous sheet on the first side. Then, the continuous sheet is cut behind the margin in the process of recording on the first side. Thus, an area for recording management information on the second side can be reserved, as in the case where an area for preliminary ejection is reserved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-139965 filed Jun. 18, 2010, which is hereby incorporated by reference herein in its entirety.

What is claimed is:

1. An image forming apparatus comprising:

a conveying unit configured to convey a continuous sheet;

an image forming unit for forming a plurality of images on a first side and a second side of the continuous sheet conveyed by the conveying unit;

a maintenance pattern forming unit configured to cause the image forming unit to form a maintenance pattern on the second side of the continuous sheet;

a cutting unit configured to cut the continuous sheet;

a reversing unit configured to wind up the continuous sheet of which a trailing end is cut by the cutting unit after the plurality of images has been formed on the first side of the continuous sheet by the image forming unit and to convey the cut continuous sheet to the image forming unit with the trailing end as a leading end; and a control unit for controlling the cutting unit, wherein the control unit causes the cutting unit to cut the continuous sheet at a trailing end of each image formed on the first side in a case where the plurality of images is formed only on the first side of the continuous sheet, and causes the cutting unit not to cut at a trailing end of each image formed on the first side and to cut the continuous sheet at a position where a margin, which corresponds to a size of the maintenance pattern, is added to a last image of the plurality of images formed on the first side of the continuous sheet in a case where the plurality of images is formed both on the first side and the second side of the continuous sheet.

2. The image forming apparatus according to claim 1, wherein the control unit performs control such that the image forming unit forms an image, based on image information, on the second side of the continuous sheet at a position which overlaps with the last image based on image information on the first side.

3. The image forming apparatus according to claim 2, wherein the image forming unit has ejection ports for ejecting ink, and a maintenance pattern is a preliminary ejection pattern used to ensure performance of ejection from the ejection ports.

4. The image forming apparatus according to claim 2, wherein the image forming unit has ejection ports for ejecting ink, and a maintenance pattern is a pattern used to detect an ejection failure in the ejection ports.

5. The image forming apparatus according to claim 1, wherein, when image formation is to be performed on the second side, a first image based on image information on the second side is formed after a maintenance pattern is formed near the trailing end formed by cutting after image formation of the first side.

6. The image forming apparatus according to claim 5, wherein the first image based on image information on the second side is formed at a position that overlaps with that of the last image based on image information on the first side.

7. The image forming apparatus according to claim 1, wherein the control unit performs control such that, when image formation is to be performed on the second side after image formation on the first side, the continuous sheet is cut off at a position such that an area for forming an image representing management information can be reserved between the trailing end formed by cutting of the continuous sheet and the first image based on image information to be formed on the second side, the first image based on image information being on the back side of the last image based on image information on the first side.

8. The image forming apparatus according to claim 7, wherein the management information is a management number for managing a printed sheet.

9. The image forming apparatus according to claim 1, wherein the reversing unit is a duplex conveying unit for conveying the continuous sheet being formed a plurality of images based on image information on a first side to the image forming unit, wherein the duplex conveying unit winds the continuous sheet from a first end and feeds the continuous sheet from a second end.

* * * * *